US005595056A

United States Patent [19]

Scheufler

[11] Patent Number: 5,595,056

[45] Date of Patent: Jan. 21, 1997

[54] RING-SPINNING MACHINE OR RING-TWISTING MACHINE WITH RING-RAIL LIFTER BRACKETS EXTENDING TOWARD VERTICAL CENTER OF GRAVITY PLANE

[75] Inventor: Mathias Scheufler, Eislingen, Germany

[73] Assignee: Zinser Textilmaschinen GmbH, Ebersbach/Fils, Germany

[21] Appl. No.: 568,536

[22] Filed: Dec. 7, 1995

[30] Foreign Application Priority Data

Dec. 14, 1994 [DE] Germany ..... 44 44 619.5

[51] Int. Cl.[6] ..... D01H 7/40; D01H 7/52

[52] U.S. Cl. ..... 57/75; 57/1 R; 57/99; 57/119; 57/122; 57/136

[58] Field of Search ..... 57/75, 1 R, 99, 57/119, 122, 136

[56] References Cited

U.S. PATENT DOCUMENTS

| | | | |
|---|---|---|---|
| 1,793,704 | 2/1931 | Lenk | 57/75 |
| 1,892,343 | 12/1932 | Hess | 57/99 |
| 2,770,093 | 11/1956 | Gwaltney | 57/99 |
| 2,912,815 | 11/1959 | Feather | 57/75 |
| 2,997,836 | 8/1961 | Leach et al. | 57/75 |
| 3,022,625 | 2/1962 | Meadows | 57/137 |
| 3,196,600 | 7/1965 | McDuffy | 57/54 |
| 4,571,931 | 2/1986 | Kupper | 57/281 |
| 4,735,039 | 4/1988 | Wunderlich | 57/136 |
| 5,125,244 | 6/1992 | Klaus | 57/281 |

FOREIGN PATENT DOCUMENTS

| | | | |
|---|---|---|---|
| 576094 | 4/1958 | Italy | 57/99 |
| 666216 | 6/1979 | U.S.S.R. | 57/1 R |
| 383221 | 11/1932 | United Kingdom | 57/75 |

*Primary Examiner*—William Stryjewski
*Attorney, Agent, or Firm*—Herbert Dubno

[57] ABSTRACT

A ring-spinning or ring-twisting machine with a ring rail having rings and travelers for each spinning or twisting spindle. The horizontal ring rail is displaceable on rigid vertical rods, the lower ends of which are connected to vertical stretches of flexible traction elements which lie substantially in the vertical plane of the weight axis of the ring rail.

9 Claims, 5 Drawing Sheets

RING-SPINNING MACHINE OR RING-TWISTING MACHINE WITH RING-RAIL LIFTER BRACKETS EXTENDING TOWARD VERTICAL CENTER OF GRAVITY PLANE

FIELD OF THE INVENTION

My present invention relates to a ring-spinning or ring-twisting machine of the type in which a spindle rail and a ring rail are mounted on a machine frame, generally on each side of the longitudinal median axis of the machine and the ring rail is vertically displaceable via rigid drive elements, especially lifting rods, engaged by traction members which are generally flexible and, upon exertion of a pull on the traction members, raise and lower the ring rail.

BACKGROUND OF THE INVENTION

In one construction of a textile machine of the ring-spinning or ring-twisting type, described, for example, in U.S. Pat. No. 3,196,600, the ring rail is provided with downwardly-extending lifting rods centrally and which are guided in guide bushings in the horizontal flanges of the spindle rail. At their lower ends the rods are engaged by bell-crank levers acting as direction-change elements which are displaced by traction members to control the lifting and lowering of the ring rail.

Mention should also be made of the construction described in U.S. Pat. No. 3,022,625 in which the rods of the ring rail are not guided in the spindle rail but guide tracks are provided rearwardly of the spindle rail for the ring rail lifting and lowering movement. The guide tracks can be arranged with the spindle rail or on an intermediate stand. The rods in this case are not displaced via bell-crank levers but are suspended via transverse connections directly on vertically deflected stretches of traction members which are arranged on the sides of the rods opposite that at which the ring rail is disposed.

In both of these constructions, in part because the weight of the ring rail is offset from the locations at which the lifting force is transmitted to the rigid rods, binding can occur in the guides for the lifting rods as a result of the transverse forces which are applied thereto and the wear of the guides and rods can be substantial while the lifting movement may become unreliable.

Objects of the Invention

It is, therefore, the principal object of the present invention to provide a textile machine construction, especially for a ring-spinning machine or a ring-twisting machine which simplifies the displacement of the ring rail and reduces wear.

Another object of the invention is to eliminate the drawbacks of earlier systems for displacing a ring rail in a textile machine.

It is also an object of the invention to provide an improved textile machine of the type in which a movable ring rail is provided, in which the danger of binding is greatly reduced.

SUMMARY OF THE INVENTION

These objects and others which will become apparent hereinafter are attained, in accordance with the present invention, in that at least a region of the traction member which applied lifting force to the rigid lifting elements on which the ring rail is mounted is located in a vertical plane of the center of gravity of the ring rail or is offset inwardly thereof toward the central longitudinal axis of the machine when a bobbin and core-sleeve transporter is provided in this plane, and the traction element is connected to the rigid rod by a transverse bracket. Under these circumstances, the weight centers of the ring rail lie substantially in the same plane as that in which the traction force of the traction member is applied as a lifting force to the rods, thereby substantially relieving transverse forces on the guides for the lifting rods, eliminating binding and substantially reducing wear. When reference is made to the longitudinal axis of the ring rail containing the center of gravity, I mean to refer to an axis of the ring rial and all attachments or other structures thereon which contribute to the weight which must be lifted and the horizontal axis along which the centers of weight acting downwardly lie. Since the ring rail is a horizontal elongated structure and normally has a center of gravity, that axis will be an axis passing through the center of gravity.

However, since the weight of the ring rail is distributed over its entire length, at each vertical transverse cross section of the ring rail there will be a center of weight and a line horizontally through these centers will define a weight axis which is a longitudinal axis. The plane referred to is a vertical plane of this axis.

According to the invention, when the machine does not have a bobbin or core-sleeve transport device forming part of a bobbin-change mechanism or simply to store or remove bobbins or make the core sleeves available, the traction members and especially the ends thereof which are connected by the brackets to the lifting rods, can be located precisely in this plane, namely, the vertical plane of the weight axis of the ring rail.

In an embodiment in which a bobbin or core-sleeve transport device is provided, it can be located outwardly of this plane away from the longitudinal central axis of the machine. It will be understood that in the usual machine, the machine frame is made up of end support members and a plurality of intermediate supports spaced apart between the end member and both spindle rails and ring rails are provided on opposite sides of this frame to either side of the longitudinal central axis of the machine. Where necessary or desirable, the machine frame can carry drafting frames on either side as well, although these are not material to the present invention.

In an embodiment in which the bobbin or core-sleeve transport device must be located in the aforementioned plane and cannot be set outwardly because of space availability, the present invention provides that the traction elements will be offset from the plane inwardly toward the longitudinal central axis but nevertheless will lie outwardly of the plane of the rods forming the rigid drive elements for lifting and lowering the ring rail.

A textile machine according to the invention in the first embodiment can thus comprise:

- a machine frame;
- a spindle rail on the machine frame having a multiplicity of spindle stations each provided with a respective spindle;
- a ring rail displaceable vertically on the machine frame and having respective rings surrounding the spindles and adapted to receive respective travelers traversed by respective yarns to be wound on bobbins of the respective spindles, the ring rail having a longitudinal axis containing the center of gravity of the ring rail;
- vertical guides on the machine frame;
- rigid vertically displaceable drive elements guided in the vertical guides and connected to the ring rail for lifting and lowering the ring rail;

at least one traction member upon which a pull can be exerted to lift the ring rail lying in a vertical plane of the longitudinal axis; and a bracket extending transverse to the traction member connecting the traction member with one of the drive elements.

In the second embodiment the textile machine can comprise:

a machine frame;

a spindle rail on the machine frame having a multiplicity of spindle stations each provided with a respective spindle;

a ring rail displaceable vertically on the machine frame and having respective rings surrounding the spindles and adapted to receive respective travelers traversed by respective yarns to be wound on bobbins of the respective spindles, the ring rail having a longitudinal axis containing the center of gravity of the ring rail;

vertical guides on the machine frame;

rigid vertically displaceable drive elements guided in the vertical guides and connected to the ring rail for lifting and lowering the ring rail;

at least one traction member upon which a pull can be exerted to lift the ring rail;

a bracket extending transverse to the traction member connecting the traction member with one of the drive elements; and a bobbin and core sleeve transporter extending along the frame and disposed in the plane, the traction member lying inwardly of the plane toward a longitudinal central axis of the machine.

In both embodiments the traction member is flexible and has a downwardly-extending end connected to the bracket which can be affixed at the lower end of a respective rigid vertical rod forming the drive element to which the traction member is coupled. A roller on the frame can serve to deflect the traction member from its vertical stretch into a horizontal stretch in which the traction member engages a linearly displaceable driver applying the pulling force or passes around another roller which can apply the pulling force.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
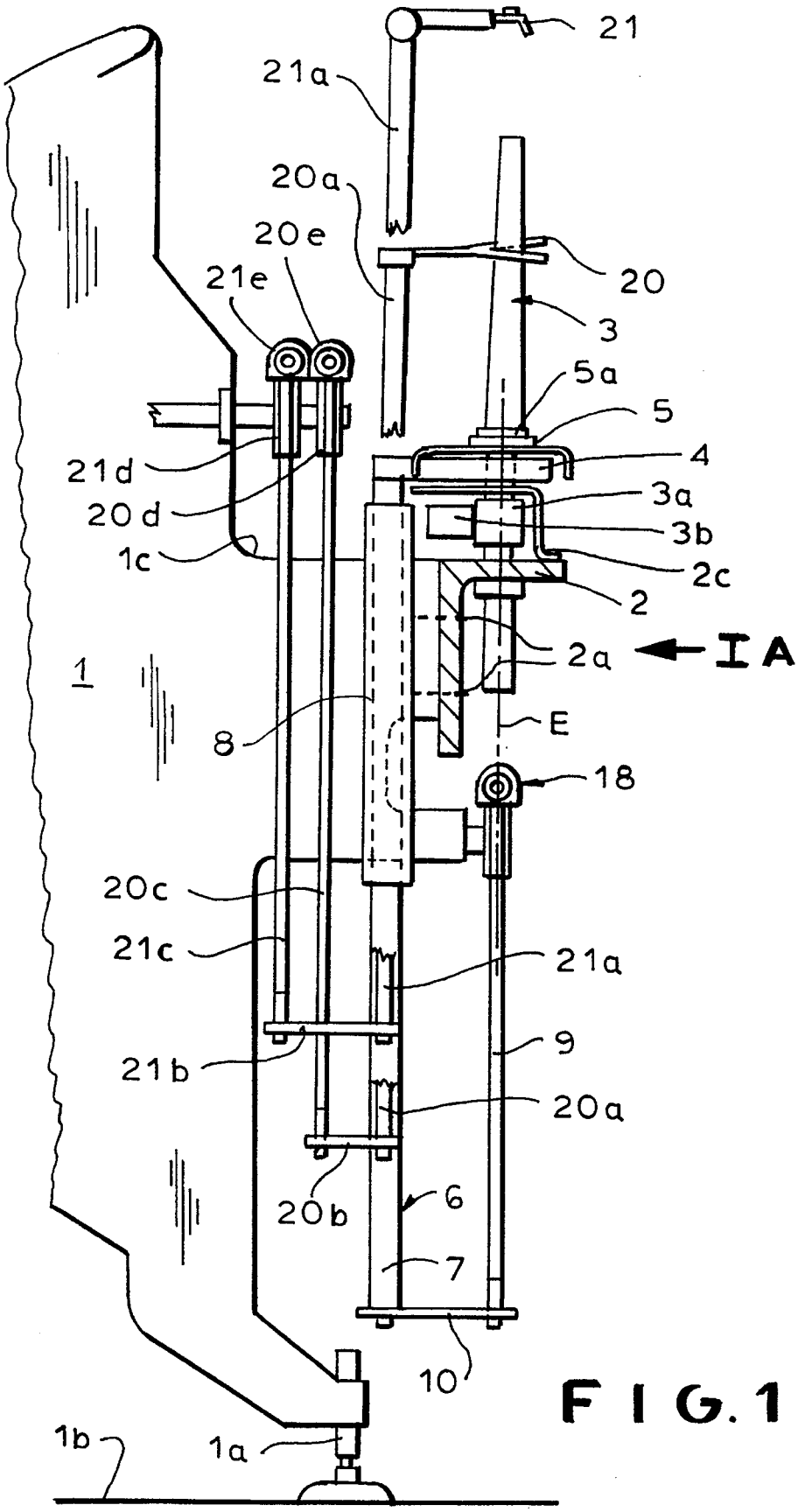
FIG. 1 is a transverse vertical section through a portion of one side of a textile machine according to the invention.
Figure 2:
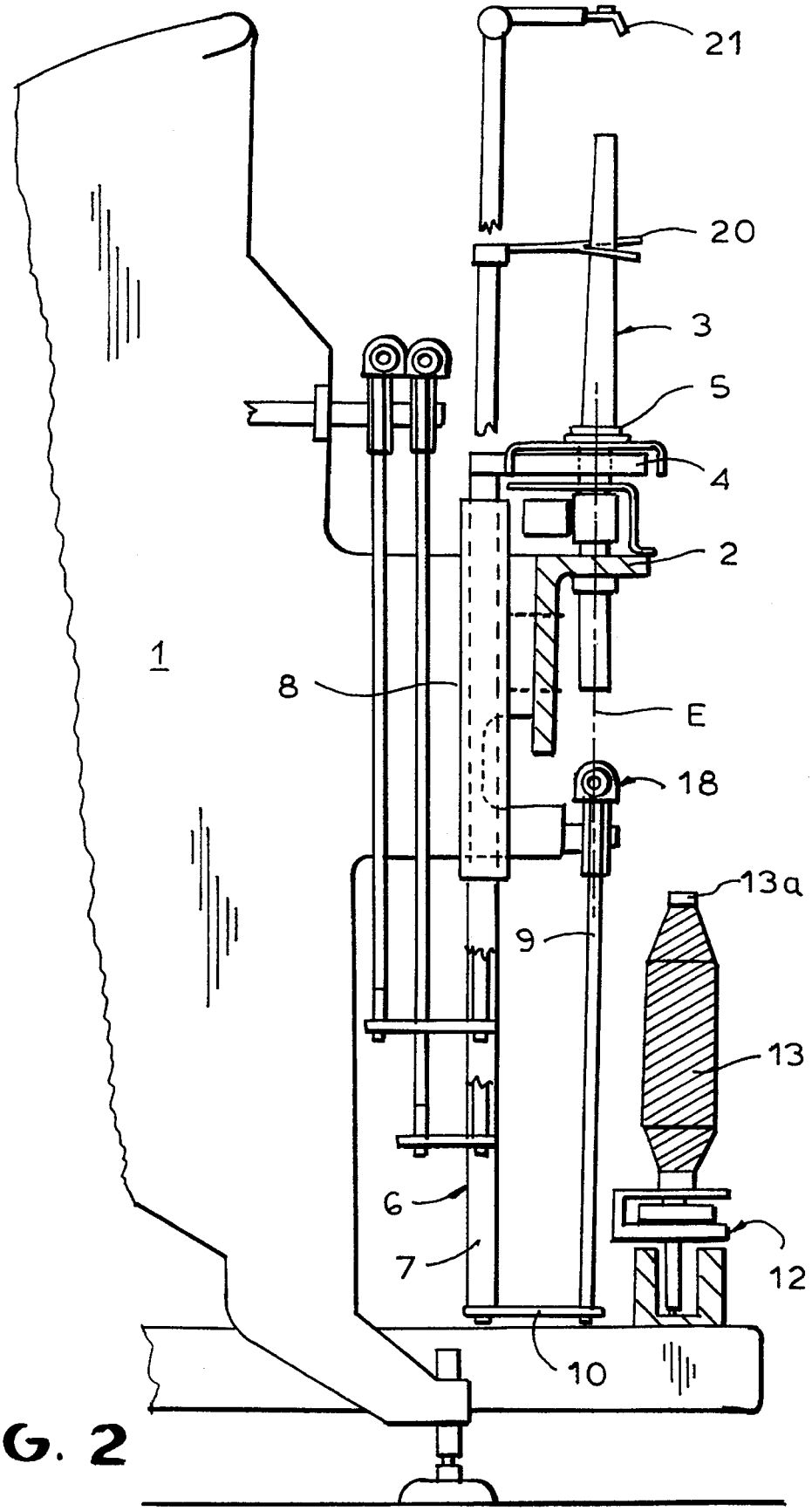
FIG. 2 is a view similar to FIG. 1 illustrating a machine provided with a bobbin and core-sleeve transporter.

FIG. 1 is a view of the lower portion of an intermediate stand 1 of the machine frame of a ring-spinning machine as an example of a textile machine according to the invention. This intermediate stand has an adjustable foot 1*a* resting on the ground 1*b* or on the plant floor and an arm 1*c* projecting to the side on which a spindle rail 2 is mounted by bolts 2*a*. The spindle rail 2 has a vertical flange 2*b* and a horizontal flange 2*c* in which the spindles 3 are journaled. The spindles 3 have whorls 3*a* which are driven at 3*b* conventionally so that the spindles rotate around respective axes, can receive the usual core sleeves and can serve to wind up respective bobbins thereon. One such bobbin is shown in FIG. 2 at 13 on a transporter and the core sleeve is visible at 13*a*.

As is conventional with both ring-spinning and ring-twisting amchines, a ring rail 4 is provided which is vertically displaceable and has a ring 5 surrounding the spindle and on which a traveler is provided as shown at 5*a*, the yarn passing, e.g. from a drafting frame not shown at an upper part of the machine frame, through a thread-guide eye 21 and the traveler 5*a* onto the bobbin on the spindle. A balloon-limiting ring 20 is provided for the ballooning yarn which tends to swing outwardly under the centrifugal force applied to the yarn.

It is also conventional to provide a vertical rod 21*a* for the eye 21 and a rod 20*a* to carry the balloon limiter 20, the rod 21*a* and the rod 20*a* being engaged by brackets 2l*b* and 20*b*, respectively, of traction members in the form of flexible bands 21*c* and 20*c* passing over rollers 21*d* and 20*d* to horizontal linear actuators 21*e* and 20*e*, respectively, thereby allowing the balloon limiter and the thread-guide eye to be vertically displaced.

Figure 1A:
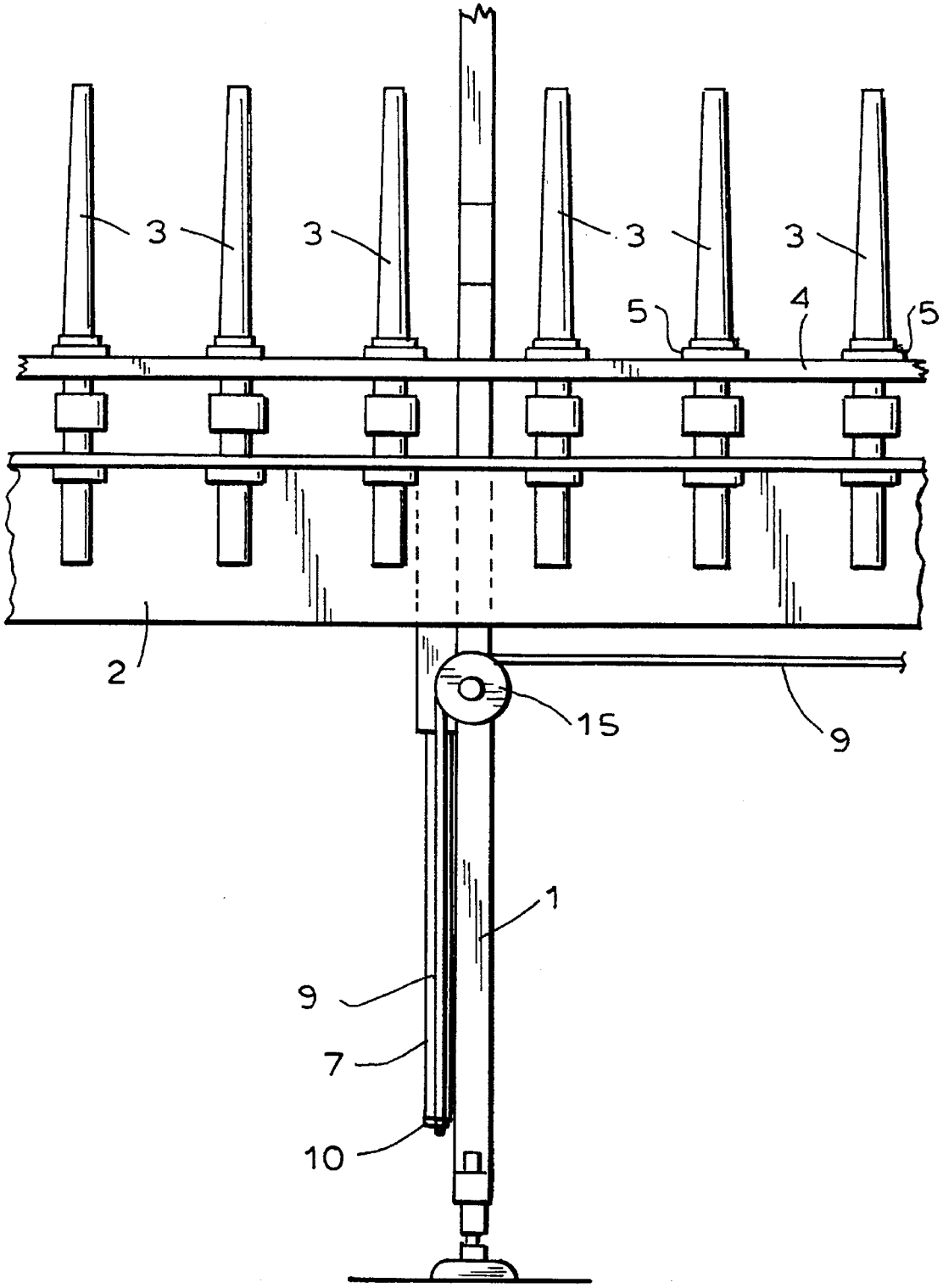
FIG. 1A is a view taken generally in the direction of the arrow IA of FIG. 1 showing one embodiment of the arrangement between the traction element and a lifting rod.

The ring rail 4 is mounted on a plurality of vertical ridge drive elements 6, shown as rigid rods 7 and only one of which is seen in detail in FIGS. 1 and 1A. The rod 7 is guided in a guide sleeve 8 which can be fixed to the arm 1*c* of the intermediate stand 1 of the machine frame. The rod 7, in turn, is displaced by a traction member 9 in the form of a flexible band, the lower end of which is affixed to the lower end of the rod 7 by a bracket extending transversely to the rod 7 and to the band 9.

As can be seen from FIG. 1A, the spindle rail 2 and the ring rail 3 extend the full length of the respective side of the machine, it being understood that another spindle rail and ring rail are provided on the opposite side of the machine, generally symmetrical with a longitudinal central axis of the machine.

Each of the traction members 9 can pass around a wheel 15 affixed to the respective stand 1 and can be displaced by a horizontal actuator represented at 18 in FIG. 1. Spindles 3 and rings 5 are thus spaced along the respective rails on each side of the machine.

The weight axis of the ring rail 4 as defined above lies in a vertical plane represented at E in FIG. 1 and parallel to the plane of the paper in FIG. 1A. In the embodiment of FIG. 1, the traction members 9 lie in this plane E and exert a lifting force on the rod 7 which are offset inwardly from this plane via the brackets 10. The weight of the ring rail 4 and the lifting force of the traction members 9 thus lie in the same plane and transverse binding stress on the guide 8 is thereby eliminated.

The embodiment of FIG. 2 differs from that of FIG. 1 in that at the bottom of the frame a bobbin and core sleeve transport device 12 is provided which can carry off full bobbins 13 and supply empty core sleeves on which new bobbins can be wound so that the machine can be serviced by a doffer. In the embodiment of FIG. 2, the bobbin and core sleeve transporter 12 is located outside the vertical plane 3 containing the weight axis of the ring rail 4. In this embodiment as well the traction members 9 are disposed in the region of the vertical plane E so that analogously to the embodiment of FIG. 1, the lifting force acting upon the rods 7 and generated by the traction member 9 will lie in this plane E. In this construction, the transporter 12 is disposed outwardly of the plane E away from the longitudinal central axis of the machine.

Figure 3:
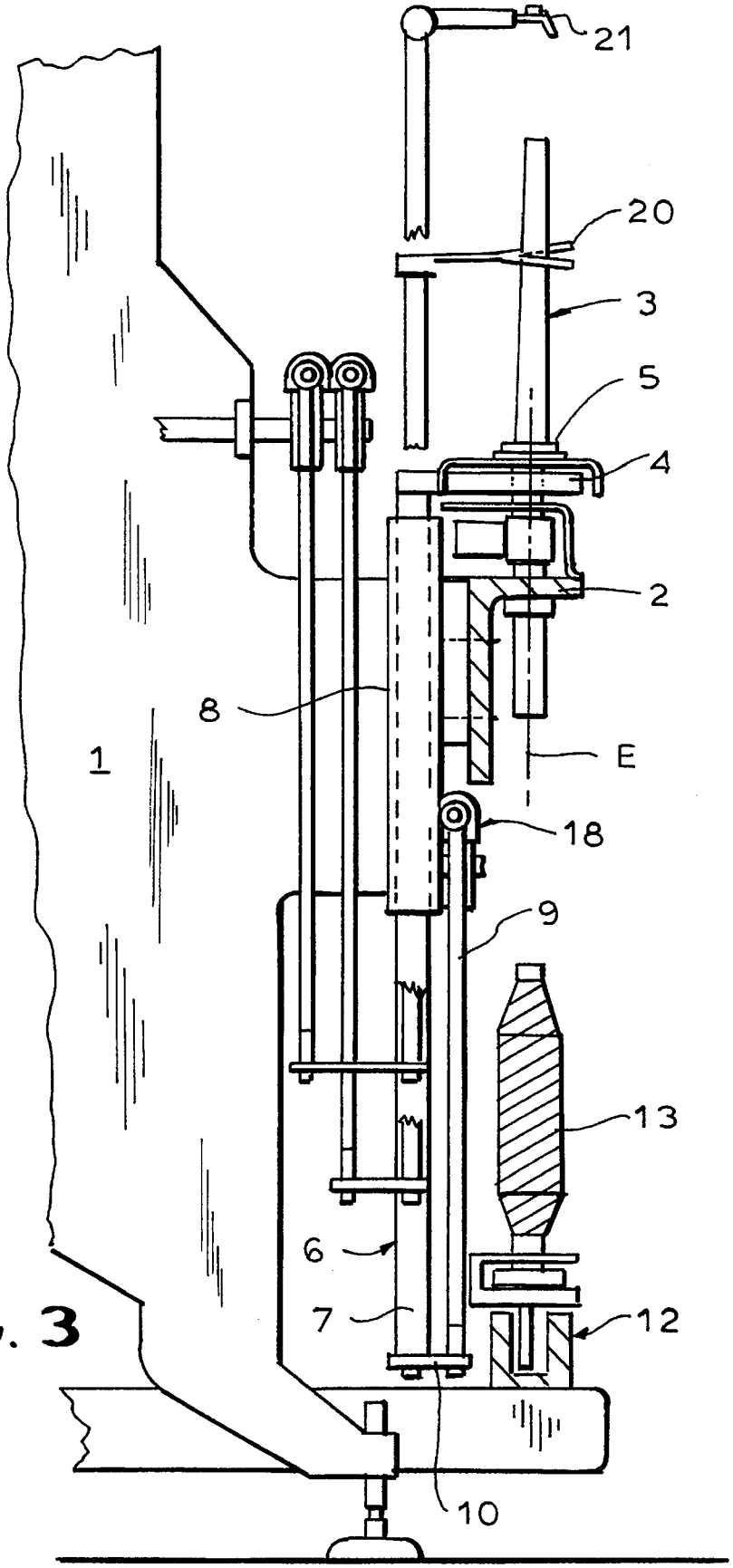
FIG. 3 is a vertical section similar to FIGS. 1 and 2 illustrating another embodiment thereof.

When the bobbin and core sleeve transporter cannot be offset from the plane E as has been shown diagrammatically in FIG. 3, the transporter 12 may lie within the plane E. In that case it has proved to be advantageous to offset the traction member 9 inwardly toward the longitudinal central axis and hence toward the rod 7 as has been shown in FIG. 3. Even in this embodiment there is largely elimination of the transverse stresses at the guides 8.

Figure 4:
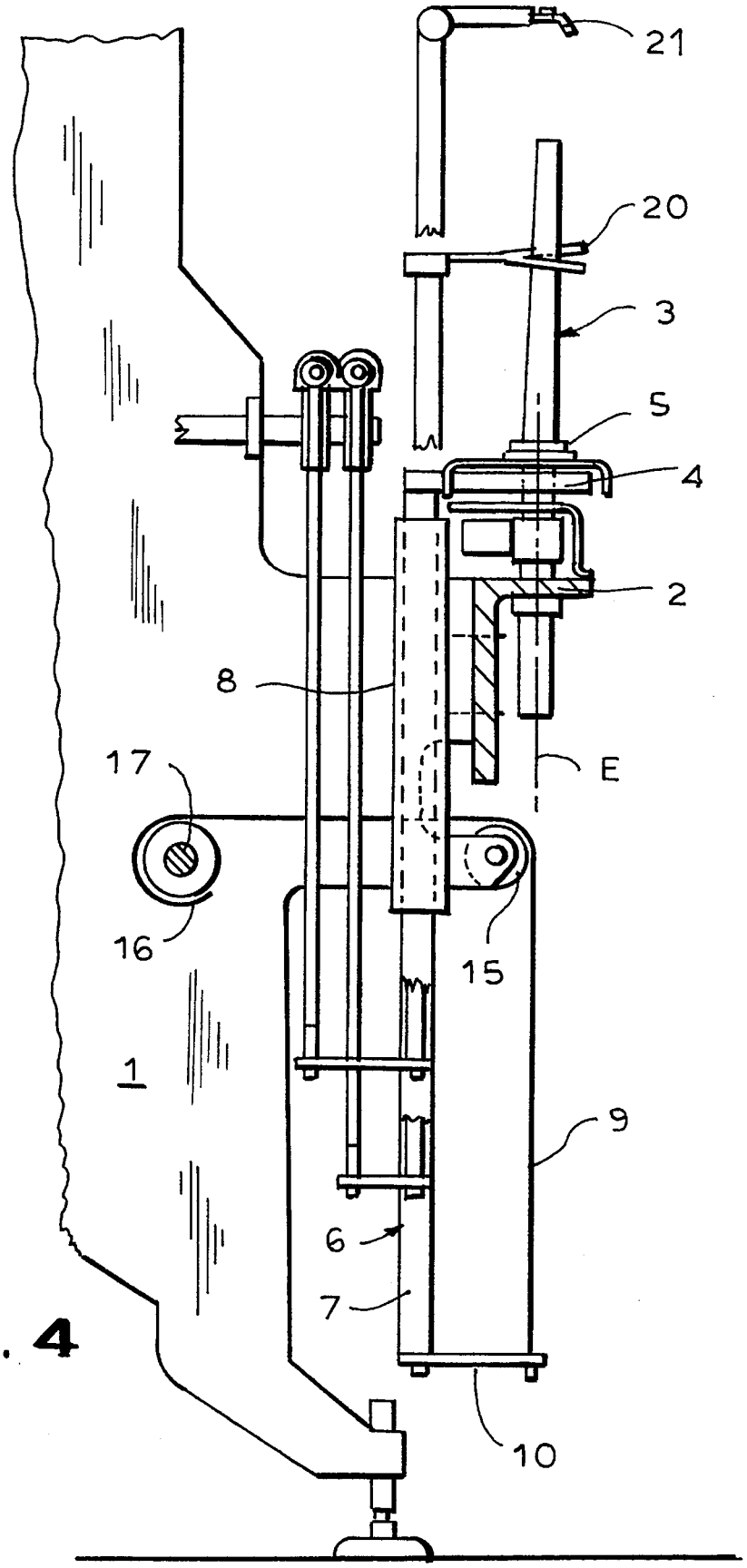
FIG. 4 is a view similar to FIG. 1 showing another modification.

From the embodiment of FIG. 4, it can be seen that the entire traction element need not lie in the plane E but that it is important that the downwardly-extending end of the traction element, exerting the lifting force on the rod 7 via the brackets 10 be located in this plane. The traction element above the guide wheel 15 can pass horizontally onto a wheel 16 rotated on a shaft 17 to form a windlass displacing the traction element 9 and generating the lifting force.

In all embodiments, therefore, the lifting force is applied by the traction member at least substantially in the vertical plane of the weight of the ring rail and thus the transverse stresses on the guide 8 are relieved and wear and the danger of binding can be eliminated.

I claim:

1. A textile machine comprising:

a machine frame;

a spindle rail on said machine frame having a multiplicity of spindle stations each provided with a respective spindle;

a horizontal ring rail displaceable vertically on said machine frame and having respective rings surrounding said spindles and adapted to receive respective travelers traversed by respective yarns to be wound on bobbins of the respective spindles, said ring rail having a longitudinal axis containing the center of gravity of the ring rail and lying in a plane of said center of gravity;

vertical guides on said machine frame below said ring rail;

rigid vertically displaceable drive elements guided in said vertical guides and connected to said ring rail for lifting and lowering said ring rail, said drive elements extending downwardly from said ring rail;

a bracket extending transversely from one of said drive elements toward said plane and affixed to said one of said drive elements below said ring rail; and at least one flexible traction member upon which a pull is exerted to lift said ring rail, said traction member extending vertically parallel to said plane.

2. The textile machine defined in claim 1, further comprising a bobbin and core sleeve transporter extending along said frame and disposed outwardly from said plane in a direction away from a longitudinal central axis of the machine.

3. A textile machine comprising:

a machine frame;

a spindle rail on said machine frame having a multiplicity of spindle stations each provided with a respective spindle;

a horizontal ring rail displaceable vertically on said machine frame and having respective rings surrounding said spindles and adapted to receive respective travelers traversed by respective yarns to be wound on bobbins of the respective spindles, said ring rail having a longitudinal axis containing the center of gravity of the ring rail and lying in a vertical plane of the center of gravity;

vertical guides on said machine frame below said ring rail;

rigid vertically displaceable drive elements guided in said vertical guides and connected to said ring rail for lifting and lowering said ring rail, said drive elements extending downwardly from said ring rail;

a bracket extending transversely from one of said drive elements toward said plane and affixed to said one of said drive elements below said ring rail; and at least one flexible traction member upon which a pull is exerted to lift said ring rail, said traction member having a vertical stretch connected to said bracket and parallel to said vertical plane of said axis; and a bobbin and core sleeve transporter extending along said frame and disposed in said plane, said traction member lying inwardly of said plane toward a longitudinal central axis of the machine.

4. The textile machine defined in claim 1, claim 2 or claim 3 wherein said traction member has a downwardly extending end connected to said bracket.

5. The textile machine defined in claim 4 wherein said one of said drive elements is a rigid vertical rod, said bracket being connected to said rod at a bottom thereof.

6. The textile machine defined in claim 5, further comprising a roller on said frame, said traction member passing over said roller.

7. The textile machine defined in claim 6 wherein said traction member also lies in a plane perpendicular to said axis and is wound on another roller for applying said pull to said traction member.

8. The textile machine defined in claim 1 or claim 3 wherein said machine is a ring spinning machine.

9. The textile machine defined in claim 1 or claim 3 wherein said machine is a ring twisting machine.

* * * * *